US011644776B1

(12) United States Patent
Ohara et al.

(10) Patent No.: US 11,644,776 B1
(45) Date of Patent: May 9, 2023

(54) ENDLESS BELT, FIXING BELT, FIXING DEVICE, AND IMAGE FORMING APPARATUS

(71) Applicant: FUJIFILM Business Innovation Corp., Tokyo (JP)

(72) Inventors: Hideaki Ohara, Kanagawa (JP); Tomotake Inagaki, Kanagawa (JP); Ryohei Yoshikawa, Kanagawa (JP); Kenji Omori, Kanagawa (JP); Kenji Kajiwara, Kanagawa (JP); Junko Yamasaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/709,432

(22) Filed: Mar. 31, 2022

(30) Foreign Application Priority Data

Oct. 14, 2021 (JP) ..... JP2021-16905 8

(51) Int. Cl.
*G03G 15/20* (2006.01)

(52) U.S. Cl.
CPC ..... *G03G 15/2057* (2013.01); *G03G 15/2053* (2013.01); *G03G 2215/2016* (2013.01)

(58) Field of Classification Search
CPC ..... G03G 15/2053; G03G 15/2057; G03G 2215/2016
See application file for complete search history.

(56) References Cited

U.S. PATENT DOCUMENTS

2010/0055365 A1* 3/2010 Nakajima ..... C08G 73/1046 428/36.9
2010/0279045 A1* 11/2010 Nakajima ..... B32B 1/08 428/36.9
2013/0101302 A1* 4/2013 Ishigai ..... G03G 15/2057 399/33

FOREIGN PATENT DOCUMENTS

| | | |
|---|---|---|
| JP | 2005017720 | 1/2005 |
| JP | 2006259248 | 9/2006 |
| JP | 2016066698 | 4/2016 |
| JP | 2016153500 | 8/2016 |

* cited by examiner

*Primary Examiner* — Joseph S Wong
(74) *Attorney, Agent, or Firm* — JCIPRNET

(57) ABSTRACT

An endless belt includes a resin and an acicular filler of which a thermal conductivity is 220 W/mK or more and 320 W/mK or less, a volume resistivity is $10^{11}$ Ωcm or more and $10^{16}$ Ωcm or less, and a content with respect to the endless belt is 1% by mass or more and 30% by mass or less.

16 Claims, 4 Drawing Sheets

ENDLESS BELT, FIXING BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-169058 filed Oct. 14, 2021.

BACKGROUND

(i) Technical Field

The present invention relates to an endless belt, a fixing belt, a fixing device, and an image forming apparatus.

(ii) Related Art

JP2005-17720A discloses a thermally conductive seamless belt which is a polyimide tubular body containing a thermally conductive inorganic fine powder, in which the thermally conductive inorganic fine powder is spherical aluminum nitride, and a content of the thermally conductive inorganic fine powder with respect to 100 parts by weight of a polyimide resin is in a range of 10 to 40 parts by weight.

In addition, JP2006-259248A discloses a transfer fixing belt using, as a base material layer, a polyimide resin-based composition containing a component A: a thermally conductive inorganic filling powder, a component B: a conductive powder, and a component C: a fluororesin powder.

In addition, JP2016-153500A discloses an insulating heat conductive polyimide resin composition including a polyimide resin and a thermally conductive insulating filler consisting of aluminum nitride or aluminum nitride whose surface is coated with aluminum oxide.

SUMMARY

Aspects of non-limiting embodiments of the present disclosure relate to an endless belt, a fixing belt, a fixing device, and an image forming apparatus that the endless belt including a resin and an acicular filler and having excellent insulation, thermal conduction property in a circumferential direction, and bending durability, comparing to a case of the acicular filler of which a thermal conductivity is less than 220 W/mK or more than 320 W/mK, a volume resistivity is less than $10^{11}$ Ωcm or more than $10^{16}$ Ωcm, or a content with respect to the endless belt is less than 1% by mass or more than 30% by mass.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

As specific means, the following aspects are contained.

According to an aspect of the present disclosure, there is provided an endless belt that includes: a resin; and an acicular filler of which a thermal conductivity is 220 W/mK or more and 320 W/mK or less, a volume resistivity is $10^{11}$ Ωcm or more and $10^{16}$ Ωcm or less, and a content with respect to the endless belt is 1% by mass or more and 30% by mass or less.

BRIEF DESCRIPTION OF THE DRAWINGS

Exemplary embodiment(s) of the present invention will be described in detail based on the following figures, wherein.

DETAILED DESCRIPTION

Figure 1:
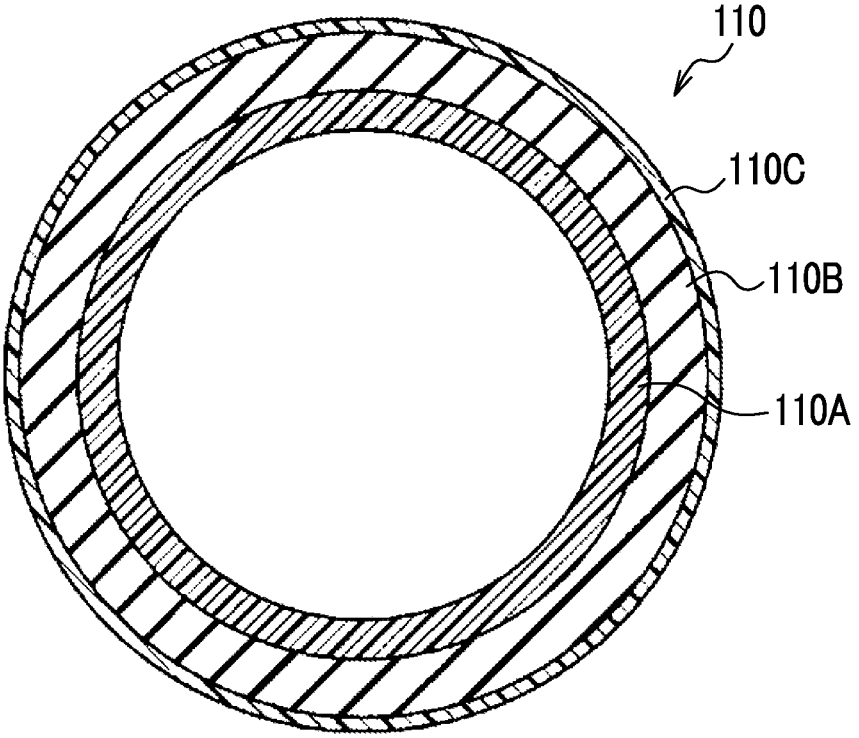
FIG. 1 is a schematic cross sectional diagram showing an example of a fixing belt according to the present disclosure.

Hereinafter, exemplary embodiments of the present disclosure will be described. These descriptions and examples illustrate the exemplary embodiments and do not limit the scope of the exemplary embodiments.

In a numerical range described stepwise in the present specification, an upper limit value or a lower limit value described in one numerical range may be replaced with an upper limit value or a lower limit value of another numerical range described stepwise.

Further, in a numerical range described in the present specification, an upper limit value or a lower limit value of the numerical range may be replaced with a value shown in examples.

In the present specification, each component may contain plural kinds of substances corresponding thereto.

In a case where the amount of each component in a composition is mentioned in the present specification and plural kinds of substances corresponding to each component are present in the composition, unless otherwise specified, the amount means a total amount of the plural kinds of substances present in the composition.

In the present specification, unless otherwise specified, a case where simply the term "endless belt according to the present disclosure" is used refers to a belt described in both a first exemplary embodiment and a second exemplary embodiment, which will be described later.

First Exemplary Embodiment of Endless Belt

A first exemplary embodiment of an endless belt according to the present disclosure includes a resin and an acicular filler of which a thermal conductivity is 220 W/mK or more and 320 W/mK or less, a volume resistivity is $10^{11}$ Ωcm or more and $10^{16}$ Ωcm or less, and a content with respect to the endless belt is 1% by mass or more and 30% by mass or less.

Hereinafter, the acicular filler of which a thermal conductivity is 220 W/mK or more and 320 W/mK or less and a volume resistivity is $10^{11}$ Ωcm or more and $10^{16}$ Ωcm or less is also referred to as a "specific acicular filler".

An endless belt containing a resin and granular aluminum nitride is known. However, in order to obtain a sufficient thermal conductivity (particularly, a thermal conduction property in a circumferential direction), the content of granular aluminum nitride is required to be increased (for example, 30% by mass or more with respect to the endless belt). In a case where the content of the granular aluminum nitride in the endless belt is increased, toughness derived from the resin may be impaired and the bending durability may be deteriorated.

On the other hand, in the first exemplary embodiment of the endless belt according to the present disclosure, the acicular filler having high thermal conductivity and high volume resistivity is contained together with the resin, in a content of 1% by mass or more and 30% by mass or less with respect to the endless belt. It is presumed that the endless belt having excellent thermal conduction property (particularly, thermal conduction property in the circumferential direction) and insulation can be obtained by combining a physical property, a shape, and a content of the acicular filler, without deteriorating the bending durability of the endless belt.

Hereinafter, in a case where the term "thermal conduction property in an endless belt" or "thermal conduction property of an endless belt" is used, the term means a thermal conduction property in a circumferential direction of the endless belt unless otherwise specified.

Hereinafter, the specific acicular filler and the resin used in the endless belt according to the present disclosure will be described.

Specific Acicular Filler

The first exemplary embodiment of the endless belt according to the present disclosure includes the acicular filler (specific acicular filler) of which a thermal conductivity is 220 W/mK or more and 320 W/mK or less and a volume resistivity is $10^{11}$ Ωcm or more and $10^{16}$ Ωcm or less.

The thermal conductivity of the specific acicular filler is 220 W/mK or more and 320 W/mK or less, and from a viewpoint of increasing the thermal conduction property of the endless belt, for example, preferably 260 W/mK or more and 320 W/mK or less, and more preferably 260 W/mK or more and 300 W/mK or less.

The thermal conductivity of the specific acicular filler is obtained by, for example, converting a thermal diffusivity measured using a thermal diffusivity measuring machine (TD-1 HTV manufactured by Advance Riko Co., Ltd.) into a thermal conductivity. In a case of measuring the thermal conductivity of the specific acicular filler contained in the endless belt, for example, a component (resin or other additives) other than the specific acicular filler contained in the endless belt is dissolved with a solvent, and a residual specific acicular filler is subjected to the measurement.

The volume resistivity of the specific acicular filler is $10^{11}$ Ωcm or more and $10^{16}$ Ωcm or less, and from the viewpoint of increasing the insulation of the endless belt, for example, preferably $10^{12}$ Ωcm or more and $10^{16}$ Ωcm or less, and more preferably $10^{14}$ Ωcm or more and $10^{16}$ Ωcm or less.

The volume resistivity of the specific acicular filler is measured, for example, using a resistivity measuring machine (SM7420 manufactured by Hioki Electric Co., Ltd.). In a case of measuring the volume resistivity of the specific acicular filler contained in the endless belt, for example, a component (resin or other additives) other than the specific acicular filler contained in the endless belt is dissolved with a solvent, and a residual specific acicular filler is subjected to the measurement.

From the viewpoint of increasing the insulation, the thermal conduction property, and the bending durability of the endless belt, a length of the specific acicular filler is, for example, preferably 100 μm or more and 6,000 μm or less, more preferably 1,000 μm or more and 5,000 μm or less, and still more preferably 2,000 μm or more and 4000 μm or less.

From the viewpoint of increasing the insulation, the thermal conduction property, and the bending durability of the endless belt, a diameter of the specific acicular filler is, for example, preferably 1 μm or more and 4 μm or less, more preferably 1.5 μm or more and 3.5 μm or less, and still more preferably 2 μm or more and 3 μm or less.

Here, the diameter of the specific acicular filler means a maximum diameter of a filler.

From the viewpoint of increasing the insulation, the thermal conduction property, and the bending durability of the endless belt, an aspect ratio of the specific acicular filler is, for example, preferably 100 or more and 2,000 or less, more preferably 500 or more and 1,600 or less, and still more preferably 900 or more and 1,200 or less.

Here, the aspect ratio of the acicular filler means a value obtained by dividing the length of the acicular filler by the diameter of the acicular filler.

The length, the diameter, and the aspect ratio of the acicular filler can be determined by the following method.

That is, 100 acicular fillers to be measured are observed with an optical microscope, and from the obtained observation image, the length and the diameter of each acicular filler (corresponding to a width of the acicular filler when the acicular filler is viewed from a side on the image) are measured, and the aspect ratio is calculated therefrom. An arithmetic mean value of the lengths of 100 acicular fillers is determined, and the arithmetic mean value is used as the length of the acicular filler. Similarly, an arithmetic mean value of the diameters of 100 acicular fillers (specifically, a largest part of the width of the acicular filler) is determined, and the arithmetic mean value is used as the diameter of the acicular filler. Furthermore, an arithmetic mean value of obtained aspect ratios of the 100 acicular fillers is determined, and the arithmetic mean value is used as the aspect ratio of the acicular filler.

In a case of measuring the length, the diameter, and the aspect ratio of the specific acicular filler contained in the endless belt, for example, a component (resin or other additives) other than the filler contained in the endless belt is dissolved with a solvent, and a residual specific acicular filler is subjected to the measurement and calculation.

The specific acicular filler is, for example, preferably an aluminum nitride single crystal from the viewpoint of increasing the thermal conduction property and insulation of the endless belt and further increasing the bending durability.

The aluminum nitride single crystal has a property that the crystal does not easily react with water. Therefore, the endless belt containing the aluminum nitride single crystal as the specific acicular filler is less likely to cause dimensional change rate due to moisture absorption, and becomes to have excellent dimensional accuracy.

In the first exemplary embodiment of the belt according to the present disclosure, the content of the specific acicular filler is 1% by mass or more and 30% by mass or less, for example, preferably 3% by mass or more and 25% by mass or less, more preferably 10% by mass or more and 20% by mass or less, and still more preferably 12% by mass or more and 18% by mass or less, with respect to the endless belt (that is, with respect to a total mass of the endless belt).

In a case of increasing the content of the specific acicular filler, the thermal conductivity of the endless belt can be increased without deteriorating the insulation of the endless belt. On the other hand, in a case where the content of the specific acicular filler is 25% by mass or less with respect to the total mass of the belt, excellent bending durability is maintained.

Resin

The first exemplary embodiment of the endless belt according to the present disclosure includes the resin.

The resin contained in the first exemplary embodiment of the endless belt according to the present disclosure is not particularly limited, and a resin appropriate for a use of the belt may be selected.

The resin contained in the first exemplary embodiment of the endless belt according to the present disclosure is, for example, a heat-resistant resin.

Examples of the resin include a heat-resistant resin or the like with high heat resistance and high strength, such as a liquid crystal material such as polyimide, aromatic polyamide, and a thermotropic liquid crystal polymer. Polyester, polyethylene terephthalate, polyethersulfone, polyetherketone, polysulfone, polyimideamide (polyamideimide), and the like are used in addition to the resins.

Among these, as the resin, for example, polyimide is preferable from the viewpoint of the heat resistance, the mechanical strength, and the like.

In the first exemplary embodiment of the endless belt according to the present disclosure, for example, polyimide, which is a heat-resistant resin, is preferable from the viewpoint of heat resistance.

Examples of the polyimide include an imidized product of a polyamic acid (precursor of a polyimide resin) which is a polymer of a tetracarboxylic acid dianhydride and a diamine compound. Specific examples of the polyimide include a resin obtained by polymerizing equimolar amounts of the tetracarboxylic acid dianhydride and the diamine compound in a solvent to obtain a polyamic acid solution, and then imidizing the polyamic acid.

Examples of the tetracarboxylic acid dianhydride include both an aromatic compound and an aliphatic compound. From the viewpoint of heat resistance, for example, the aromatic compound is preferable.

Examples of the aromatic tetracarboxylic acid dianhydride include pyromellitic acid dianhydride, 3,3',4,4'-benzophenone tetracarboxylic acid dianhydride, 3,3',4,4'-biphenyl sulfone tetracarboxylic acid dianhydride, 1,4,5,8-naphthalene tetracarboxylic acid dianhydride, 2,3,6,7-naphthalene tetracarboxylic acid dianhydride, 3,3',4,4'-biphenyl ether tetracarboxylic acid dianhydride, 3,3',4,4'-dimethyldiphenylsilane tetracarboxylic acid dianhydride, 3,3',4,4'-tetraphenylsilane tetracarboxylic acid dianhydride, 1,2,3,4-furantetracarboxylic acid dianhydride, 4,4'-bis(3,4-dicarboxyphenoxy) diphenylsulfide dianhydride, 4,4'-bis(3,4-dicarboxyphenoxy) diphenylsulfone dianhydride, 4,4'-bis(3,4-dicarboxyphenoxy) diphenylpropane dianhydride, 3,3',4,4'-perfluoroisopropylidene diphthalic acid dianhydride, 3,3',4,4'-biphenyl tetracarboxylic acid dianhydride, 2,3,3',4'-biphenyl tetracarboxylic acid dianhydride, bis(phthalic acid) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, and bis(triphenylphthalic acid)-4,4'-diphenyl methane dianhydride.

Examples of the aliphatic tetracarboxylic acid dianhydride include an aliphatic or alicyclic tetracarboxylic acid dianhydride such as butanetetracarboxylic acid dianhydride, 1,2,3,4-cyclobutanetetracarboxylic acid dianhydride, 1,3-dimethyl-1,2,3,4-dyclobutanetetracarboxylic acid dianhydride, 1,2,3,4-cyclopentanetetracarboxylic acid dianhydride, 2,3,5-tricarboxycyclopentylacetic acid dianhydride, 3,5,6-tricarboxyorbornane-2-acetic acid dianhydride, 2,3,4,5-tetrahydrofuran tetracarboxylic acid dianhydride, 5-(2,5-dioxotetrahydrofuryl)-3-methyl-3-cyclohexene-1,2-dicarboxylic acid dianhydride, and bicyclo[2,2,2]-oct-7-ene-2,3,5,6-tetracarboxylic acid dianhydrides; and an aliphatic tetracarboxylic dianhydride having an aromatic ring such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

Among these, as the tetracarboxylic acid dianhydride, the aromatic tetracarboxylic acid dianhydride may be used. Specifically, for example, the pyromellitic acid dianhydride, the 3,3',4,4'-biphenyl tetracarboxylic acid dianhydride, the 2,3,3',4'-biphenyl tetracarboxylic acid dianhydride, the 3,3',4,4'-biphenyl ether tetracarboxylic acid dianhydride, and the 3,3',4,4'-benzophenone tetracarboxylic acid dianhydride may be used. Further, for example, pyromellitic acid dianhydride, the 3,3',4,4'-biphenyl tetracarboxylic acid dianhydride, and the 3,3',4,4'-benzophenone tetracarboxylic acid dianhydride may be used. In particular, for example, the 3,3',4,4'-biphenyl tetracarboxylic acid dianhydride may be used.

The tetracarboxylic acid dianhydride may be used alone or two or more kinds thereof may be used in combination.

Further, in a case where two or more kinds of the tetracarboxylic acid dianhydrides are used in combination, each of the aromatic tetracarboxylic acid dianhydrides and the aliphatic tetracarboxylic acid dianhydrides may be used in combination, and the aromatic tetracarboxylic acid dianhydride and the aliphatic tetracarboxylic acid dianhydride may be combined.

On the other hand, the diamine compound is a diamine compound having two amino groups in a molecular structure. Examples of the diamine compound include both an aromatic compound and an aliphatic compound, and for example, the aromatic compound is preferable.

Examples of the diamine compound include an aromatic diamine such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy) phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenylene isopropylidene)bisaniline, 4,4'-(m-phenylene isopropylidene)bisaniline, 2,2'-bis[4-(4-amino trifluoromethylphenoxy)phenyl]hexafluoropropane, and 4,4'-bis[4-(4-amino-2-trifluoromethyl)phenoxy]-octafluorobiphenyl; an aromatic diamine, having two amino groups bonded to an aromatic ring and a hetero atom other than a nitrogen atom of the amino groups, such as diaminotetraphenylthiophene; and an aliphatic diamine and an alicyclic diamine such as 1,1-m-xylylenediamine, 1,3-propane diamine, tetramethylenediamine, pentamethylenediamine, octamethylenediamine, nonamethylenediamine, 4,4-diaminoheptamethylenediamine, 1,4-diaminocyclohexane, isophorone diamine, tetrahydrodicyclopentadienylenediamine, hexahydro-4,7-methanoin danylene dimethylenediamine, tricyclo[6,2,1,$0^{2,7}$]-undecylenic methyldiamine, and 4,4'-methylene bis (cyclohexylamine).

Among these, for example, as the diamine compound, the aromatic diamine compound may be used. Specifically, for example, the p-phenylenediamine, the m-phenylenediamine, the 4,4'-diaminodiphenylmethane, the 4,4'-diaminodiphenyl ether, the 3,4'-diaminodiphenyl ether, the 4,4'-diaminodiphenyl sulfide, and the 4,4'-diaminodiphenyl sulfone may be used. In particular, for example, the 4,4'-diaminodiphenyl ether and the p-phenylenediamine may be used.

The diamine compound may be used alone or two or more kinds thereof may be used in combination.

In addition, in a case where two or more kinds of the diamine compound are used in combination, each of the aromatic diamine compounds and the aliphatic diamine compounds may be used in combination, and the aromatic diamine compound and the aliphatic diamine compound may be combined.

Among these, from the viewpoint of heat resistance, the polyimide is, for example, preferably the aromatic polyimide (specifically, an imidized product of a polyamic acid (precursor of a polyimide resin) which is a polymer of an aromatic tetracarboxylic acid dianhydride and an aromatic diamine compound.

The aromatic polyimide is, for example, more preferably a polyimide having a structural unit represented by the following General Formula (PI1).

(PI1)

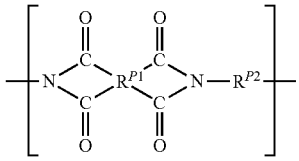

In General Formula (PI1), $R^{P1}$ represents a phenyl group or a biphenyl group, and $R^{P2}$ represents a divalent aromatic group.

Examples of the divalent aromatic group represented by $R^{P2}$ include a phenylene group, a naphthyl group, a biphenyl group, and a diphenyl ether group. From the viewpoint of bending durability, as the divalent aromatic group, for example, the phenylene group and the biphenyl group are preferable.

The number average molecular weight of the polyimide may be 5,000 or more and 100,000 or less, for example, more preferably 7,000 or more and 50,000 or less, and still more preferably 10,000 or more and 30,000 or less.

The number average molecular weight of the polyimide is measured by a gel permeation chromatography (GPC) method under the following measurement conditions.

Column: Tosoh TSK gel α-M (7.8 mm ID×30 cm)

Eluent: DMF (dimethylformamide)/30 mM LiBr/60 mM phosphoric acid

Flow velocity: 0.6 mL/min

Injection amount: 60 μL

Detector: RI (differential refractive index detector)

In the first exemplary embodiment of the endless belt according to the present disclosure, a content of the resin is, for example, preferably 75% by mass or more, more preferably 80% by mass or more, still more preferably 85% by mass or more, and particularly preferably 90% by mass or more, with respect to a total mass of the belt.

Additive

The first exemplary embodiment of the endless belt according to the present disclosure may include a well-known additive such as a filler and a lubricant other than the specific acicular filler, in addition to the specific acicular filler and the resin.

Physical Property of Belt

In the first exemplary embodiment of the endless belt according to the present disclosure, for example, the thermal conductivity in the circumferential direction is preferably 0.5 W/mK or more and 3.0 W/mK or less, and the volume resistance value is preferably $10^{13}$ Ωcm or more and $10^{16}$ Ωcm or less.

That is, it is preferable that the endless belt according to the present disclosure has, for example, the above-mentioned thermal conductivity and the above-mentioned volume resistivity.

Thermal Conductivity

In the first exemplary embodiment of the endless belt according to the present disclosure, as described above, the thermal conductivity in the circumferential direction is, for example, preferably 0.5 W/mK or more and 3.0 W/mK or less, more preferably 1.0 W/mK or more and 3.0 W/mK or less, and still more preferably 1.5 W/mK or more and 3.0 W/mK or less.

The thermal conductivity of the belt is measured as follows.

That is, a flat plate-shaped test piece is cut out from a target belt, and the thermal conductivity is determined from a thermal diffusivity in a thickness direction of the test piece. Specifically, the test piece is placed on a holder of the thermal diffusivity measuring device TD-1 HTV (manufactured by Advance Riko Co., Ltd.), and the thermal diffusivity is measured three times in an atmosphere. An arithmetic mean value of the values of the three times of measurement is used as the thermal diffusivity of the belt, and the density and a specific heat of the belt are converted into the thermal conductivity.

According to the measuring device and the measuring method, it is possible to measure the thermal conductivity in an axial direction of the belt and the circumferential direction of the belt, in addition to a thickness direction of the belt.

Volume Resistivity

In the first exemplary embodiment of the endless belt according to the present disclosure, as described above, the volume resistivity is, for example, preferably $10^{13}$ Ωcm or more and $10^{16}$ Ωcm or less, more preferably $10^{14}$ Ωcm or more and $10^{16}$ Ωcm or less, and still more preferably $10^{15}$ Ωcm or more and $10^{16}$ Ωcm or less.

Here, the volume resistivity of the endless belt is measured as follows.

A micro ammeter (R8430A manufactured by Advantest) is used as a resistance measuring machine, and a UR probe (manufactured by Mitsubishi Chemical Analytech Co., Ltd.) is used as a probe. The volume resistivity (Ωcm) of the endless belt is measured at total 18 points of 6 points at equal intervals in the circumferential direction and 3 points at the center and both ends in the width direction at a voltage of 500V, for an applying time of 10 seconds, at a pressurization of 1 kgf, to calculate a mean value. In addition, the measurement is performed in an environment of a temperature of 22° C. and a humidity of 55% RH.

Orientation of Acicular Filler

In the first exemplary embodiment of the endless belt according to the present disclosure, it is preferable that the specific acicular filler is, for example, oriented in the circumferential direction of the endless belt. In this manner, in a case where the specific acicular filler in the endless belt is oriented in the circumferential direction, the thermal conductivity in the circumferential direction of the endless belt is increased comparing to the thermal conductivity in the thickness direction and the axial direction of the endless belt.

An orientation ratio of the specific acicular filler with respect to the circumferential direction of the endless belt is, for example, preferably 70% or more, more preferably 80% or more, and still more preferably 90% or more, from the viewpoint of increasing the thermal conductivity in the circumferential direction of the endless belt. For example, an upper limit of the orientation ratio may be 100% or 90%.

Here, an orientation ratio A of the acicular filler with respect to the circumferential direction of the endless belt is determined by the following method.

That is, the orientation ratio A is represented by Equation 1, when a total number of the acicular fillers is set as N and the number of acicular fillers in which an inclination θ in the length direction of the acicular filler with respect to the circumferential direction of the endless belt satisfies −30° e 30° is set as N'.

$$\text{Orientation ratio } A=(N'/N)\times 100 \qquad \text{Equation 1:}$$

N, θ, and N' when determining the orientation ratio A are measured by the following method.

Specifically, the outer peripheral surface of the endless belt is observed with an optical microscope at 10 parts at equal intervals from one end to the other end in a width direction, and 5 acicular fillers are extracted at each location, for a total of 50 acicular fillers. For all of the extracted 50 acicular fillers (that is, the total number N of acicular fillers=50), the inclination θ of the acicular filler in the length direction with respect to the circumferential direction of the endless belt is measured, and the number N' at which the acicular fillers satisfy $-30° \leq \theta \leq 30°$. The obtained value is substituted into Equation 1 above to calculate the orientation ratio A.

Examples of a method of controlling the orientation ratio A within the range include a method of adjusting a coating condition when manufacturing the endless belt by using a flow coat method (also referred to as a spiral winding coating method). In the flow coat method, for example, while rotating a cylindrical or columnar substrate, a coating liquid for forming an endless belt is applied from one end to the other end of the outer peripheral surface of the substrate in a rotation axis direction of the substrate (that is, a width direction of the endless belt). In this case, the orientation ratio A can be controlled by adjusting a condition of moving speed of a discharge portion of the coating liquid in a rotation axis direction.

Second Exemplary Embodiment of Belt

A second exemplary embodiment of the endless belt according to the present disclosure includes a resin and an acicular filler of which a content with respect to the endless belt is 1% by mass or more and 30% by mass or less, in which a thermal conductivity in the circumferential direction is 0.5 W/mK or more and 3.0 W/mK or less, and a volume resistivity is $10^{13}$ Ωcm or more and $10^{16}$ Ωcm or less.

As is clear from the above configuration, the second exemplary embodiment of the endless belt according to the present disclosure has high thermal conductivity in the circumferential direction and insulation, and is excellent in bending durability because the content of the acicular filler is suppressed to a low level.

In the second exemplary embodiment of the endless belt according to the present disclosure, for example, it is more preferable that the thermal conductivity in the circumferential direction is 1.0 W/mK or more and 3.0 W/mK or less, and the volume resistivity is $10^{14}$ Ωcm or more and $10^{16}$ Ωcm or less.

The second exemplary embodiment of the endless belt according to the present disclosure preferably contains, for example, a resin and a specific acicular filler, as in the first exemplary embodiment of the endless belt according to the present disclosure. That is, the acicular filler in the second exemplary embodiment of the endless belt according to the present disclosure is, for example, preferably a specific acicular filler.

Each of the resin and the acicular filler (for example, preferably a specific acicular filler) in the second exemplary embodiment is the same as an aspect of the first exemplary embodiment.

Further, the second exemplary embodiment of the endless belt according to the present disclosure may also contain a well-known additive.

Further, also in the second exemplary embodiment of the endless belt according to the present disclosure, the acicular filler (for example, preferably a specific acicular filler) is, for example, preferably oriented in the circumferential direction of the endless belt, and the orientation ratio thereof A is, for example, preferably 70% or more, more preferably 80% or more, and still more preferably 90% or more. An upper limit of the orientation ratio may be 100% or 90%.

Belt Shape

A diameter, a width, and a film thickness of the endless belt according to the present disclosure may be appropriately determined according to the use.

The film thickness of the endless belt according to the present disclosure is, for example, 50 μm or more and 600 μm or less, preferably 50 μm or more and 500 μm or less, and more preferably 50 μm or more and 400 μm or less, from the viewpoint of increasing the bending durability of the endless belt.

The film thickness of the belt is measured as follows. That is, the film thickness of the belt to be measured is measured at the following measurement positions.

First, a total width of the belt is measured at 5 mm intervals along an axial direction of the belt. In addition, the measurement positions in a circumferential direction of the belt are four points at 90° intervals.

An eddy current type film thickness meter ISOSCOPE MP30 manufactured by Fisher Instruments K. K. is used to measure the film thickness of the belt.

Manufacturing Method

The endless belt according to the present disclosure is manufactured by the following method.

That is, the endless belt according to the present disclosure is obtained by preparing a coating liquid containing each component configuring the belt, applying the obtained coating liquid onto a cylindrical base material, and drying the coating liquid. The coating liquid contains a resin, an acicular filler, other components (additives) used as needed, and the like.

In a case where the resin is polyimide, the endless belt according to the present disclosure is obtained by preparing a coating liquid containing a polyamic acid (precursor of a polyimide resin), an acicular filler, and other components (an additive) used as necessary, and the like, applying the obtained coating liquid onto a cylindrical base material, and firing (that is, imidizing) the coating liquid.

When preparing the coating liquid, a dispersion liquid in which an acicular filler is dispersed in a solvent in advance may be used. In this case, a coating liquid is obtained by dissolving the resin (or polyamic acid) in the obtained dispersion liquid.

When obtaining a dispersion liquid containing an acicular filler, for example, in addition to a dispersion method such as a ball mill, a sand mill, a bead mill, and a jet mill (opposed collision type disperser), high pressure dispersion using a high pressure homogenizer or the like is used.

Further, the coating of the coating liquid is not particularly limited, and for example, a flow coat method (spiral winding coating method) is used. By using the flow coat method, as described above, a form in which the acicular filler is oriented in the circumferential direction of the endless belt is obtained.

Fixing Belt

The fixing belt according to the present disclosure includes the above-mentioned endless belt according to the present disclosure and a surface layer provided on an outer peripheral surface of the endless belt, and for example, preferably further includes an elastic layer provided between the endless belt and the surface layer.

That is, the fixing belt according to the present disclosure uses the endless belt according to the present disclosure as a base material layer, and includes a surface layer thereon, or the elastic layer and the surface layer.

Since the fixing belt according to the present disclosure has the endless belt according to the present disclosure having high thermal conduction property in the circumferential direction and insulation, and excellent bending durability, as the base material layer, it is possible to shorten the heating time, reduce power consumption, increase fixing speed, and the like, and service life may be further extended. Since the endless belt according to the present disclosure is also excellent in thermal conduction property in the circumferential direction, a temperature distribution in the circumferential direction of the endless belt is unlikely to occur. The fixing belt according to the present disclosure provided with the endless belt according to the present disclosure also shortens the time (so-called FPOT, first printout time) from image formation operation start (for example, image formation instruction from a user, start reading the original to be copied, and the like) to the completion and an output of image formation onto the first recording medium. Further, in a case where the acicular filler is an aluminum nitride single crystal, the endless belt according to the present disclosure is unlikely to change in size due to moisture absorption. Therefore, the fixing belt of the present disclosure provided with the endless belt is also excellent in dimensional stability. As a result, an image defect (image flaw) caused by the dimensional change rate of the fixing belt can be suppressed.

The fixing belt according to the present disclosure will be described with reference to FIG. 1.

FIG. 1 is a schematic cross sectional diagram showing an example of the fixing belt according to the present disclosure.

A fixing belt 110 shown in FIG. 1 includes a base material layer 110A, an elastic layer 110B provided on the base material layer 110A, and a surface layer 110C provided on the elastic layer 110B.

A layer structure of the fixing belt 110 according to the present disclosure is not limited to the layer structure shown in FIG. 1, and may also be a layer structure in which an adhesive layer is interposed between the base material layer 110A and the elastic layer 110B, a layer structure in which an adhesive layer is interposed between the elastic layer 110B and the surface layer 110C, a layer structure having no elastic layer 110B, a layer structure having no surface layer 110C, and a layer structure combining these layer structures.

Hereinafter, components of the fixing belt according to the present disclosure will be described in detail. The description will be made without reference numerals.

Base Material Layer

In the fixing belt according to the present disclosure, the endless belt according to the present disclosure is used as a base material layer.

The film thickness of the base material layer in the fixing belt according to the present disclosure is, for example, preferably 50 μm or more and 110 μm or less, more preferably 60 μm or more and 100 μm or less, and particularly preferably 70 μm or more and 90 μm or less, from the viewpoints of thermal conduction property in the circumferential direction, insulation, and bending durability.

The endless belt manufacturing method according to the present disclosure described above may be applied to form the base material layer.

Elastic Layer

The fixing belt according to the present disclosure has, for example, an elastic layer on a base material layer (that is, the endless belt according to the present disclosure).

The elastic layer may be a layer having elasticity and is not particularly limited.

The elastic layer is a layer provided in the viewpoint of imparting elasticity to a pressure applied to the fixing belt from an outer peripheral side, and plays a role of bringing the surface of the fixing belt into close contact with the toner image by following unevenness of a toner image on a recording medium.

The elastic layer may be configured of, for example, an elastic material that restores an original shape even in a case where the material is deformed by applying an external force of 100 Pa.

Examples of the elastic material used for the elastic layer include a fluororesin, a silicone resin, a silicone rubber, a fluororubber, and a fluorosilicone rubber. As the material of the elastic layer, for example, the silicone rubber and the fluororubber are preferable, and the silicone rubber is more preferable, from the viewpoints of heat resistance, thermal conduction property, insulation, and the like.

Examples of the silicone rubber include RTV silicone rubber, HTV silicone rubber, and liquid silicone rubber. Specific examples thereof include polydimethyl silicone rubber (MQ), methyl vinyl silicone rubber (VMQ), methylphenyl silicone rubber (PMQ), and fluorosilicone rubber (FVMQ).

As the silicone rubber, for example, it is preferable to use a silicone rubber in which most of crosslinking-forms are addition reaction type. In addition, various types of functional groups are known for the silicone rubber. For example, dimethyl silicone rubber having a methyl group, methylphenyl silicone rubber having a methyl group and a phenyl group, and vinyl silicone rubber having a vinyl group (vinyl group-containing silicone rubber) are preferably used.

Further, as the silicone rubber, for example, a vinyl silicone rubber having a vinyl group is more preferable. For example, a silicone rubber having an organopolysiloxane structure having a vinyl group and a hydrogen organopolysiloxane structure having a hydrogen atom (SiH) bonded to a silicon atom is still more preferable.

Examples of the fluororubber include vinylidene fluoride rubber, ethylene/propylene tetrafluoride rubber, ethylene/perfluoromethyl tetrafluoride vinyl ether rubber, phosphazene rubber, and fluoropolyether.

The elastic material used for the elastic layer contains, for example, preferably silicone rubber as a major component (that is, contains 50% by mass or more of silicone rubber with respect to the total mass of the elastic material).

The content of the silicone rubber is, for example, more preferably 90% by mass or more, still more preferably 99% by mass or more, and may also be 100% by mass, with respect to the total mass of the elastic material used for the elastic layer.

The elastic layer may further contain an inorganic filler for the purpose of reinforcement, heat resistance, heat transfer, and the like, in addition to the elastic material. Examples of the inorganic filler include known fillers, and for example, fuming silica, crystalline silica, iron oxide, alumina, and metallic silicon are preferable.

Examples of the material of the inorganic filler include, in addition to the above, known inorganic fillers such as carbides (such as carbon black, carbon fiber, and carbon nanotubes), titanium oxide, silicon carbide, talc, mica, kaolin, calcium carbonate, calcium silicate, magnesium oxide, graphite, silicon nitride, boron nitride, cerium oxide, and magnesium carbonate.

Among these, for example, the silicon nitride, the silicon carbide, the graphite, the boron nitride, and the carbides are preferable, from the viewpoint of thermal conduction property.

In addition, as the inorganic filler in the elastic layer, the above-mentioned specific acicular filler may be used. Specifically, as the inorganic filler, the aluminum nitride single crystal may be used.

The content of the inorganic filler in the elastic layer may be determined according to the required thermal conduction property, mechanical strength, and the like. For example, the content is 1% by mass or more and 20% by mass or less, preferably 3% by mass or more and 15% by mass, and more preferably 5% by mass or more and 10% by mass or less.

In addition, the content of the specific acicular filler in the elastic layer may be determined according to the required thermal conduction property, mechanical strength, and the like. For example, the content is 3% by mass or more and 25% by mass or less, preferably 10% by mass or more and 20% by mass, and more preferably 12% by mass or more and 18% by mass or less.

Further, the elastic layer may contain, as the additive, for example, a softening agent (such as paraffin-based softening agent), a processing aid (such as stearic acid), an anti-aging agent (such as amine-based anti-aging agent), a vulcanizing agent (such as sulfur, metal oxide, and peroxide).

The thickness of the elastic layer is, for example, preferably 30 μm or more and 600 μm or less, and more preferably 100 μm or more and 500 μm or less.

A known method may be applied to form the elastic layer, for example, a coating method is applied.

In a case where the silicone rubber is used as the elastic material of the elastic layer, for example, first, a coating liquid for forming an elastic layer containing a liquid silicone rubber that is cured by heating to become a silicone rubber is prepared. Next, the coating liquid for forming an elastic layer is applied onto the base material layer to form a coating film, and as needed, the coating film is vulcanized to form an elastic layer on the base material layer. In the vulcanization of the coating film, the vulcanization temperature is, for example, 150° C. or higher and 250° C. or lower, and the vulcanization time is, for example, 30 minutes or longer and 120 minutes or shorter.

Surface Layer

The fixing belt according to the present disclosure preferably has, for example, a surface layer on the base material layer or the elastic layer.

The surface layer is a layer that plays a role of suppressing the toner image in a molten state from sticking to the surface (outer peripheral surface) on a side in contact with the recording medium at the time of fixing.

The surface layer is required to have, for example, heat resistance and releasability. From the viewpoint, for the material configuring the surface layer, for example, a heat-resistant release material is preferably used, and specific examples thereof include fluororubber, fluororesin, silicone resin, and polyimide resin.

Among these, for example, the fluororesin may be used as the heat-resistant release material.

Specific examples of the fluororesin include a tetrafluoroethylene-perfluoroalkyl vinyl ether copolymer (PFA), polytetrafluoroethylene (PTFE), a tetrafluoroethylene-hexafluoropropylene copolymer (FEP), a polyethylene-tetrafluoro ethylene copolymer (ETFE), polyvinylidene fluoride (PVDF), polychlorotrifluoroethylene (PCTFE), and vinyl fluoride (PVF).

The surface of the surface layer on the elastic layer side may be subjected to a surface treatment. The surface treatment may be a wet treatment or a dry treatment, and examples thereof include a liquid ammonia treatment, an excimer laser treatment, and a plasma treatment.

The thickness of the surface layer is, for example, preferably 10 μm or more and 100 μm or less, and more preferably 20 μm or more and 50 μm or less.

A known method may be applied to form the surface layer, and for example, a coating method may be applied.

Further, the surface layer may be formed by preparing a tubular surface layer in advance and coating the outer periphery of the elastic layer with the surface layer. An adhesive layer (for example, an adhesive layer containing a silane coupling agent having an epoxy group) may be formed on an inner surface of the tubular surface layer and then the outer periphery may be coated therewith.

The film thickness of the fixing belt according to the present disclosure is, for example, preferably 90 μm or more and 600 μm or less, more preferably 200 μm or more and 600 μm or less, and further preferably 300 μm or more and 550 μm or less.

Use of Fixing Belt Member

The fixing belt according to the present disclosure is, for example, applied to both a heating belt and a pressure belt.

Fixing Device

The fixing device according to the present disclosure has various configurations, for example, may include a fixing device including a first rotating body and a second rotating body arranged in contact with the outer surface of the first rotating body, in which a toner image is fixed by inserting a recording medium having the toner image formed on a surface into a contact portion between the first rotating body and the second rotating body. Then, the fixing belt according to the present disclosure is applied as least one of the first rotating body or the second rotating body.

Hereinafter, the fixing device according to the present disclosure will be described as a fixing device including a heating roll and a pressure belt as a first exemplary embodiment and a fixing device including a heating belt and a pressure roll as a second exemplary embodiment. Then, in the first exemplary embodiment, the fixing belt according to the present disclosure may be applied to both the heating belt and the pressure belt.

The fixing device according to the present disclosure is not limited to the first and second exemplary embodiments, and may be a fixing device including a heating roll or a heating belt and a pressure belt. The fixing belt according to the present disclosure may be applied to both the heating belt and the pressure belt.

The base material layer of the fixing belt according to the present disclosure contains an acicular filler that itself has excellent insulation, and is the endless belt according to the present disclosure that also has excellent insulation as a belt. Therefore, the fixing belt according to the present disclosure is, for example, suitable for a configuration below in which a heating pressing roll (that is, the heating pressing roll provided with a heating unit) for pressing the heating belt against the pressure roll side from the inner peripheral surface thereof is provided in a sandwiching region N (nip portion), as shown in the second exemplary embodiment of the fixing device. In a case where the fixing belt according to the present disclosure is applied to the fixing device having such a configuration, the base material layer by the endless belt according to the present disclosure ensures the insulation between the fixing belt according to the present disclosure and the heating pressing roll and the insulation is maintained. Therefore, stabilization of fixation by the fixing device is achieved.

First Exemplary Embodiment of Fixing Device

Figure 2:
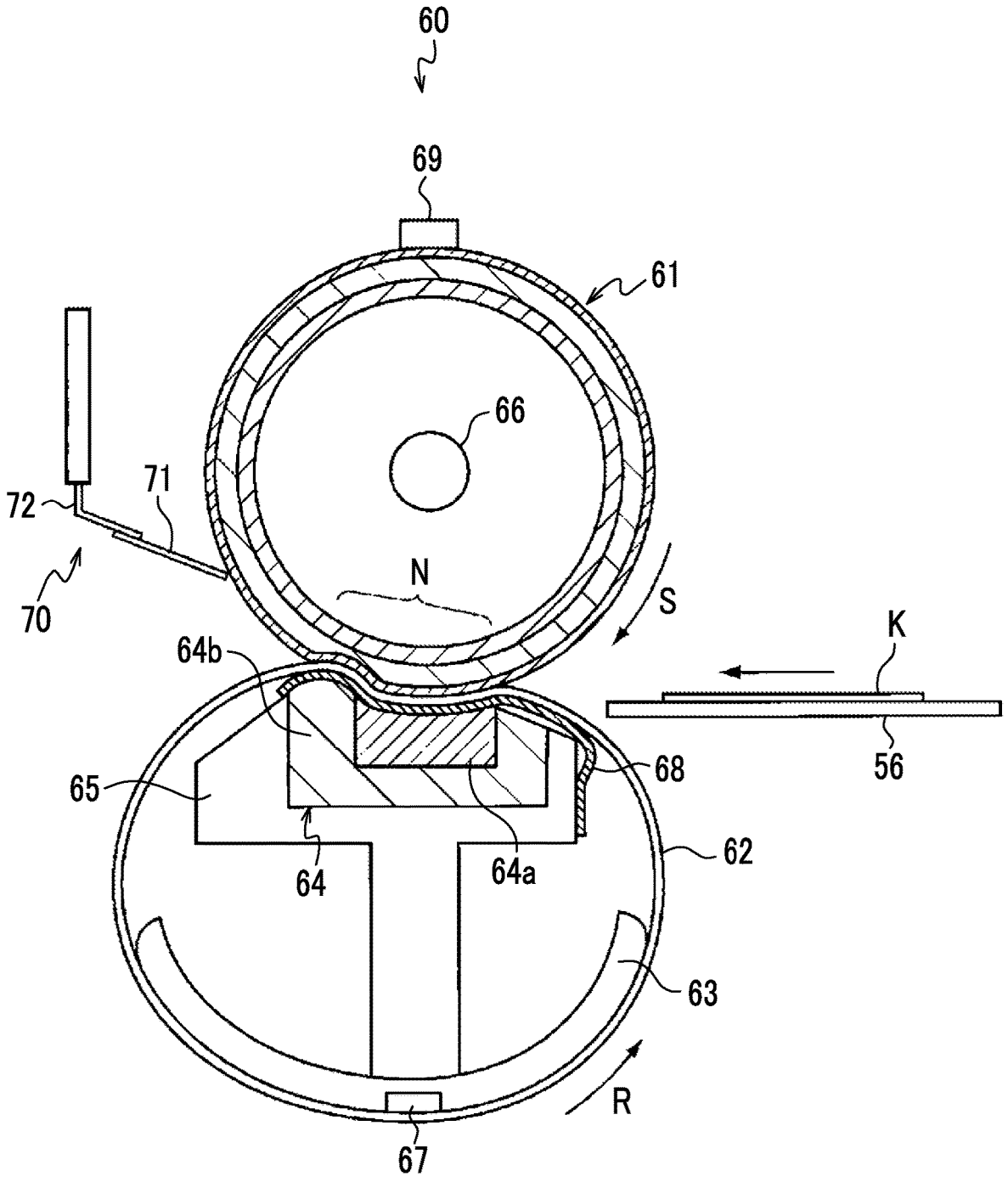
FIG. 2 is a schematic configuration diagram showing an example of a first exemplary embodiment of the fixing device according to the present disclosure.

The first exemplary embodiment of the fixing device will be described with reference to FIG. 2. FIG. 2 is a schematic diagram showing an example of a first exemplary embodiment of the fixing device (that is, a fixing device 60).

As shown in FIG. 2, the fixing device 60 is configured to include, for example, a heating roll 61 (an example of a first rotating body) driven to rotate, a pressure belt 62 (an example of a second rotating body), and a pressing pad 64 (an example of pressing member) that presses the heating roll 61 via the pressure belt 62.

Regarding the pressing pad 64, for example, the pressure belt 62 and the heating roll 61 may be relatively pressed. Therefore, a pressure belt 62 side may be pressed to the heating roll 61, and a heating roll 61 side may be pressed to the pressure belt 62.

A halogen lamp 66 (an example of heating unit) is arranged inside the heating roll 61. The heating unit is not limited to the halogen lamp, and other heat-generating members that generate heat may be used.

On the other hand, for example, a temperature sensitive element 69 is arranged in contact with the surface of the heating roll 61. The lighting of the halogen lamp 66 is controlled based on a temperature measurement value by the temperature sensitive element 69, and a surface temperature of the heating roll 61 is maintained at a target set temperature (for example, 150° C.)

The pressure belt 62 is rotatably supported by, for example, a pressing pad 64 arranged therein and a belt traveling guide 63. In a sandwiching region N (nip portion), the pressure belt is arranged by being pressed against the heating roll 61 by the pressing pad 64.

The pressing pad 64 is arranged in a state of being pressed to the heating roll 61 via the pressure belt 62 inside the pressure belt 62, and forms a sandwiching region N with the heating roll 61, for example.

In the pressing pad 64, for example, a front sandwiching member 64*a* for securing a wide sandwiching region N is arranged on an inlet side of the sandwiching region N, and a peeling sandwiching member 64*b* for giving distortion to the heating roll 61 is arranged on an outlet side of the sandwiching region N.

In order to reduce sliding resistance between an inner peripheral surface of the pressure belt 62 and the pressing pad 64, for example, a sheet-like sliding member 68 is provided on a surface of the front sandwiching member 64*a* and the peeling sandwiching member 64*b* in contact with the pressure belt 62. The pressing pad 64 and the sliding member 68 are held by a metal holding member 65.

The sliding member 68 is provided, for example, so that a sliding surface thereof is in contact with an inner peripheral surface of the pressure belt 62, and is involved in holding and supplying an oil existing between the sliding member 68 and the pressure belt 62.

For example, a belt traveling guide 63 is attached to the holding member 65, and the pressure belt 62 is configured to rotate.

The heating roll 61 rotates, for example, in a direction of an arrow S by a drive motor (not shown), and the pressure belt 62 rotates by being driven the rotation of the heating roll 61, in a direction of an arrow R opposite to the rotation direction of the heating roll 61. That is, for example, the heating roll 61 rotates clockwise in FIG. 2, while the pressure belt 62 rotates counterclockwise.

Then, paper K (an example of the recording medium) having an unfixed toner image is guided by, for example, the fixing inlet guide 56 and transported to the sandwiching region N. In a case where the paper K passes through the sandwiching region N, the unfixed toner image on the paper K is fixed by the pressure and heat acting on the sandwiching region N.

In the fixing device 60, for example, a concave front sandwiching member 64*a* that follows the outer peripheral surface of the heating roll 61 secures a wider sandwiching region N as compared with a configuration without the front sandwiching member 64*a*.

Further, for example, by arranging the peeling sandwiching member 64*b* so as to protrude from the outer peripheral surface of the heating roll 61, the fixing device 60 is configured such that the distortion of the heating roll 61 becomes locally large in the outlet region of the sandwiching region N.

In a case where the peeling sandwiching member 64*b* is arranged in this manner, for example, the paper K after fixing passes through locally large formed distortion when passing through the peeling sandwiching region, and thus the paper K is easy to be peeled off from the heating roll 61.

As an auxiliary unit for peeling, for example, a peeling member 70 is arranged on a downstream side of the sandwiching region N of the heating roll 61. The peeling member 70 is, for example, held by the holding member 72 in a state where a peeling claw 71 is close to the heating roll 61 in a direction facing the rotation direction of the heating roll 61 (counter direction).

Second Exemplary Embodiment of Fixing Device

Figure 3:
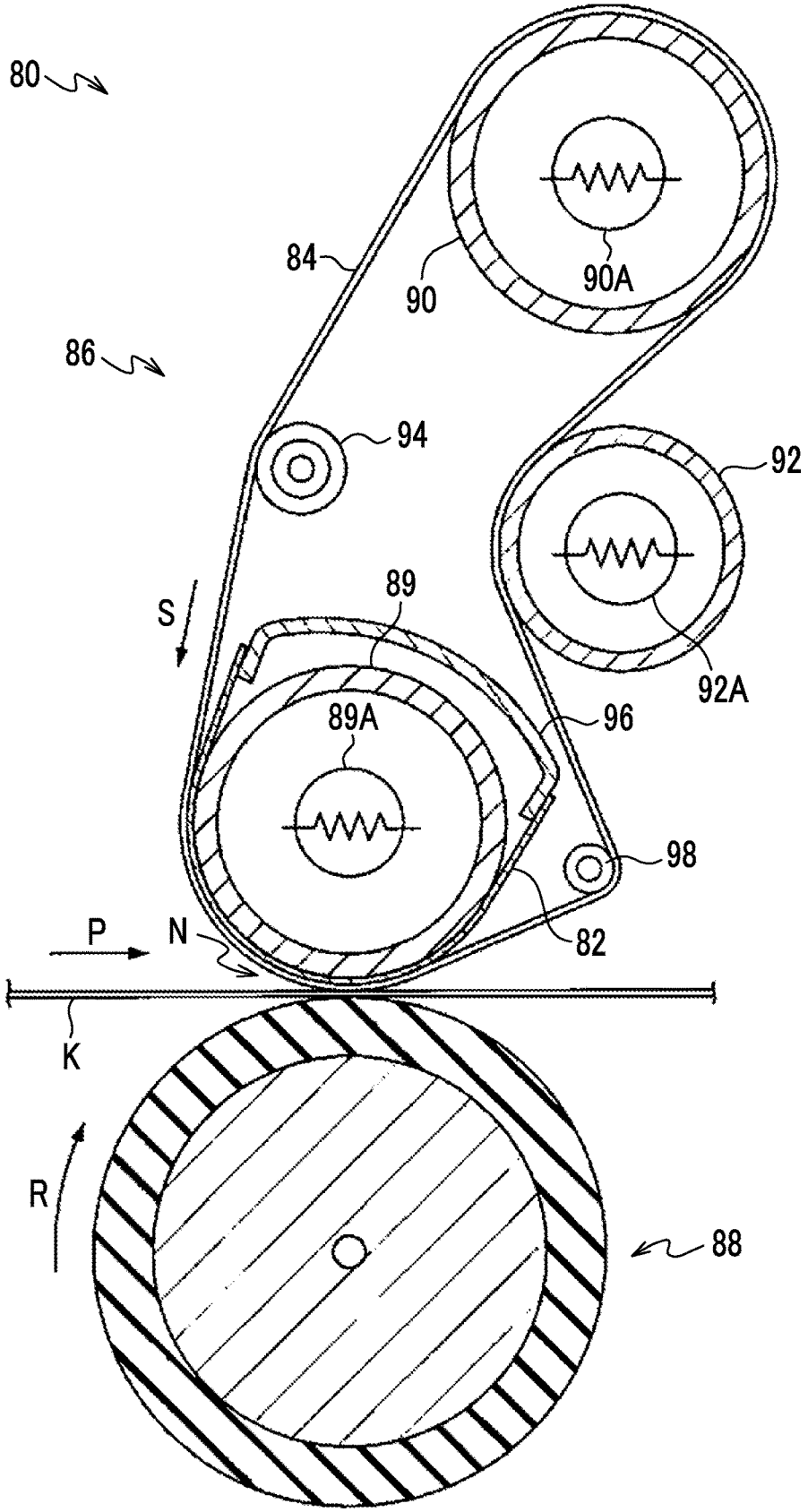
FIG. 3 is a schematic configuration diagram showing an example of a second exemplary embodiment of the fixing device according to the present disclosure.

A second exemplary embodiment of the fixing device will be described with reference to FIG. 3. FIG. 3 is a schematic diagram showing an example of a second exemplary embodiment of the fixing device (that is, a fixing device 80).

As shown in FIG. 3, the fixing device 80 is configured to include, for example, a fixing belt module 86 including a heating belt 84 (an example of the first rotating body) and a pressure roll 88 (an example of the second rotating body) arranged by being pressed to the heating belt 84 (the fixing belt module 86). For example, the sandwiching region N (nip portion) is formed in a contact portion between the heating belt 84 (fixing belt module 86) and the pressure roll 88. In the sandwiching region N, the paper K (an example of the recording medium) is pressed and heated, and the toner image is fixed.

The fixing belt module 86 includes, for example, an endless heating belt 84, a heating pressing roll 89 around which the heating belt 84 is wound on the pressure roll 88 side, and which is rotationally driven by the rotational force of a motor (not shown) and presses the heating belt 84 from an inner peripheral surface thereof toward the pressure roll 88, and a support roll 90 that supports the heating belt 84 from the inside at a position different from the heating pressing roll 89.

The fixing belt module 86 is, for example, provided with a support roll 92 that is arranged outside the heating belt 84 and defines a circuit path thereof, and a posture correction roll 94 that corrects the posture of the heating belt 84 from the heating pressing roll 89 to the support roll 90, and a support roll 98 that applies tension to the heating belt 84 from the inner peripheral surface on the downstream side of the sandwiching region N formed by the heating belt 84 and the pressure roll 88.

The fixing belt module 86 is provided, for example, so that a sheet-like sliding member 82 is interposed between the heating belt 84 and the heating pressing roll 89.

The sliding member 82 is provided, for example, so that a sliding surface thereof is in contact with an inner peripheral surface of the heating belt 84, and is involved in holding and supplying an oil existing between the sliding member 82 and the heating belt 84.

Here, the sliding member 82 is provided, for example, in a state where both ends thereof are supported by the support member 96.

Inside the heating pressing roll 89, for example, a halogen heater 89A (an example of heating unit) is provided.

The support roll 90 is, for example, a cylindrical roll formed of aluminum, and a halogen heater 90A (an example of heating unit) is arranged inside, so that the heating belt 84 is heated from the inner peripheral surface side.

At both ends of the support roll 90, for example, spring members (not shown) that press the heating belt 84 outward are arranged.

The support roll 92 is, for example, a cylindrical roll made of aluminum, and a release layer consisting of a fluororesin having a thickness of 20 μm is formed on a surface of the support roll 92.

The release layer of the support roll 92 is formed, for example, to prevent a toner or a paper dust from the outer peripheral surface of the heating belt 84 from accumulating on the support roll 92.

For example, a halogen heater 92A (an example of the heating unit) is arranged inside the support roll 92 so that the heating belt 84 is heated from the outer peripheral surface side.

That is, for example, the heating pressing roll 89, the support roll 90, and the support roll 92 are configured to heat the heating belt 84.

The posture correction roll 94 is, for example, a columnar roll formed of aluminum, and an end position measurement mechanism (not shown) for measuring the end position of the heating belt 84 is arranged in the vicinity of the posture correction roll 94.

The posture correction roll 94 is provided with, for example, an axial displacement mechanism (not shown) that displaces a contact position of the heating belt 84 in an axial direction according to the measurement result of the end position measurement mechanism, and is configured to control meandering of the heating belt 84.

On the other hand, the pressure roll 88 is provided, for example, rotatably supported, and the heating belt 84 is provided by being pressed against a portion wound around the heating pressing roll 89 by an urging unit such as a spring (not shown). As a result, as the heating belt 84 (heating pressing roll 89) of the fixing belt module 86 moves rotationally in a direction of an arrow S, the pressure roll 88 follows the heating belt 84 (heating pressing roll 89) and moves rotationally in a direction of an arrow R.

Then, the paper K having the unfixed toner image (not shown) is transported in a direction of the arrow P and guided to the sandwiching region N of the fixing device 80. When the paper K passes through the sandwiching region N, the unfixed toner image on the paper K is fixed by the pressure and heat acting on the sandwiching region N.

In the fixing device 80, a form in which the halogen heater (halogen lamp) is adopted as an example of plural heating units has been described, but the present disclosure is not limited thereto. A radiation lamp heating element (a heating element that generates radiation (such as infrared rays) and a resistance heating element (heating element that generates Joule heat by passing an electric current through a resistor: for example, a ceramic substrate formed with a film having resistance and fired) may be adopted.

Image Forming Apparatus

Next, the image forming apparatus according to the present disclosure will be described.

The image forming apparatus according to the present disclosure includes an image holder; a charging unit that charges a surface of the image holder; an electrostatic latent image forming unit that forms an electrostatic latent image on the charged surface of the image holder; a developing unit that develops the electrostatic latent image formed on the surface of the image holder by a developer containing a toner to form a toner image; a transfer unit that transfers the toner image to a surface of a recording medium; and a fixing unit that fixes the toner image to the recording medium.

As the fixing unit, the fixing device according to the present disclosure is adopted.

Here, in the image forming apparatus according to the present disclosure, the fixing device may be made into a cartridge so as to be attached to and detached from the image forming apparatus. That is, the image forming apparatus according to the present disclosure may include the fixing device according to the present disclosure as a configuring device of a process cartridge.

Hereinafter, the image forming apparatus according to the present disclosure will be described with reference to the drawings.

Figure 4:
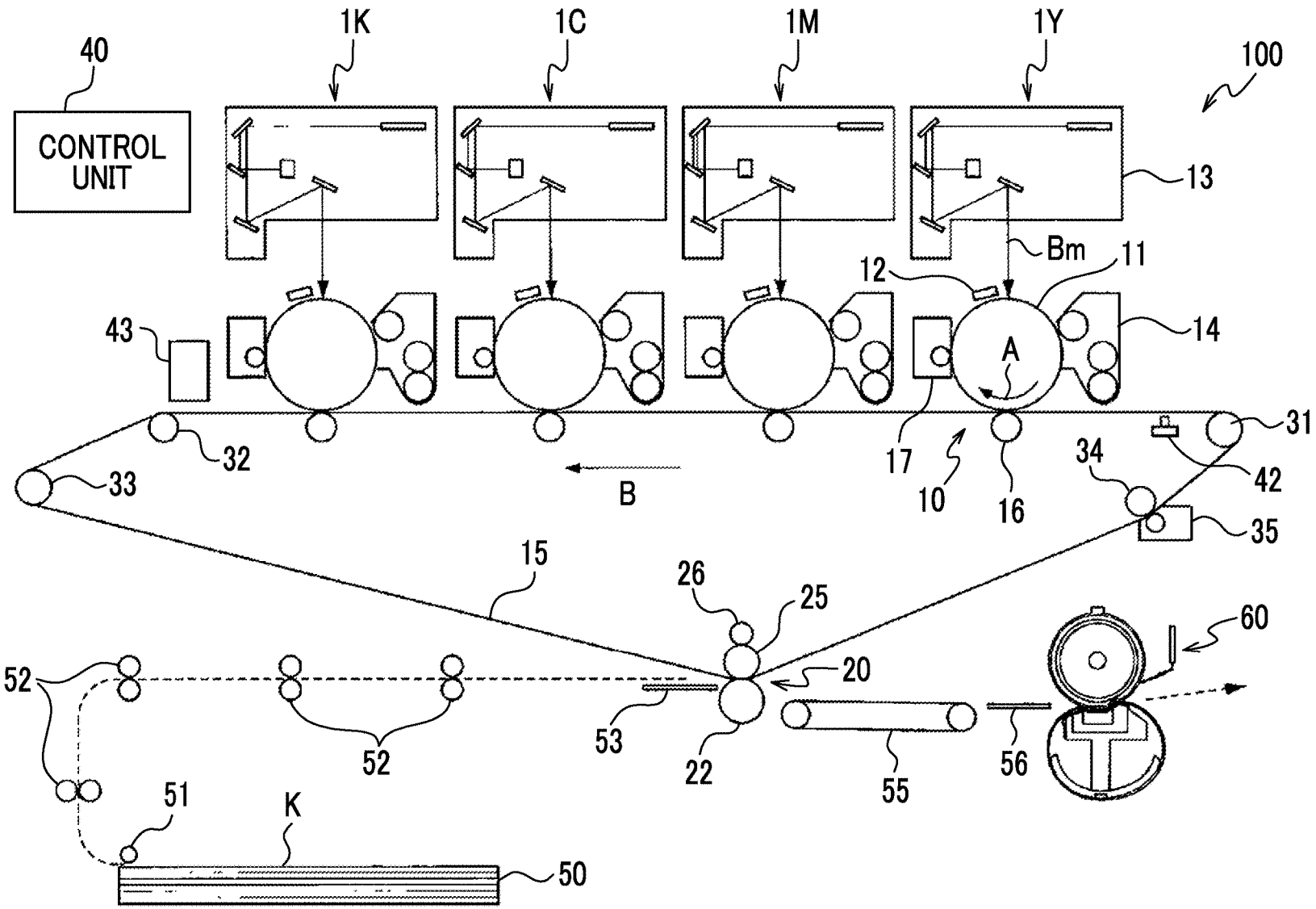
FIG. 4 is a schematic configuration diagram showing an example of an image forming apparatus according to the present disclosure.

FIG. 4 is a schematic configuration diagram showing an example of an image forming apparatus according to the present disclosure.

As shown in FIG. 4, the image forming apparatus 100 according to the present disclosure is, for example, an intermediate transfer type image forming apparatus generally called a tandem type, and includes: plural image forming units 1Y, 1M, 1C, and 1K in which each color component toner image is formed by electrophotographic method; a primary transfer unit 10 that sequentially transfers (primary transfer) each color component toner image formed by each of the image forming units 1Y, 1M, 1C, and 1K to an intermediate transfer belt 15; a secondary transfer unit 20 that collectively transfers (secondary transfer) superimposed toner image transferred on the intermediate transfer belt 15 to paper K, which is a recording medium; and a fixing device 60 that fixes a secondarily transferred image on the paper K. Further, the image forming apparatus 100 has a control unit 40 that controls an operation of each device (each unit).

The fixing device 60 is the first exemplary embodiment of the fixing device described above. The image forming apparatus 100 may be configured to include the second exemplary embodiment of the fixing device described above.

Each of the image forming units 1Y, 1M, 1C, and 1K of the image forming apparatus 100 includes a photoconductor 11 that rotates in the direction of the arrow A as an example of an image holder that holds a toner image formed on the surface.

Around the photoconductor 11 as an example of a charging unit, a charger 12 that charges the photoconductor 11 is provided and a laser exposure machine 13 (in the drawing, an exposure beam is indicated by the reference numeral Bm) that writes an electrostatic latent image on the photoconductor 11 as an example of the latent image forming unit is provided.

Further, around the photoconductor 11, a developing machine 14 in which each color component toner is accommodated and the electrostatic latent image on the photoconductor 11 is visualized by a toner is provided as an example of the developing unit, and a primary transfer roll 16 that transfers the toner image of each color component formed on the photoconductor 11 to the intermediate transfer belt 15 by the primary transfer unit 10.

Further, around the photoconductor 11, a photoconductor cleaner 17 that removes a residual toner on the photoconductor 11 is provided, and electrophotographic devices of the charger 12, the laser exposure machine 13, the developing machine 14, the primary transfer roll 16, and the photoconductor cleaner 17 are sequentially provided along the rotation direction of the photoconductor 11. These image forming units 1Y, 1M, 1C, and 1K are arranged substantially linearly in the order of yellow (Y), magenta (M), cyan (C), and black (K) from the upstream side of the intermediate transfer belt 15.

The intermediate transfer belt 15 which is an intermediate transfer body is configured of a film-shaped pressure belt in which a resin such as polyimide or polyamide is used as a base layer and an appropriate amount of an antistatic agent such as carbon black is contained. The intermediate transfer belt is formed to have a volume resistivity of $10^6$ Ωcm or more and $10^{14}$ Ωcm or less, and is configured to have a thickness of, for example, about 0.1 mm.

The intermediate transfer belt 15 is circulated (rotated) by various rolls in a B direction shown in FIG. 4 at a speed appropriate for the purpose. Examples of the various rolls include: a drive roll 31 that is driven by a motor (not shown) having excellent constant speed to rotate the intermediate transfer belt 15; a support roll 32 that supports the intermediate transfer belt 15 extending substantially linearly along the arrangement direction of each photoconductor 11; a tension applying roll 33, which applies tension to the intermediate transfer belt 15 and functions as a correction roll for preventing the intermediate transfer belt 15 from meandering; a back surface roll 25 provided on the secondary transfer unit 20; and a cleaning back surface roll 34 provided in the cleaning unit that scraps off the residual toner on the intermediate transfer belt 15.

The primary transfer unit 10 is configured of the primary transfer roll 16 arranged so as to face the photoconductor 11 with the intermediate transfer belt 15 interposed therebetween. The primary transfer roll 16 is configured of a core body and a sponge layer as an elastic layer fixed around the core body. The core body is a cylindrical rod made of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Then, the primary transfer roll 16 is arranged to be in contact with the photoconductor 11 with the intermediate transfer belt 15 interposed therebetween, and is configured such that a voltage (primary transfer bias) with an opposite polarity to a charging polarity (minus polarity and the same applies below) of the toner is applied to the primary transfer roll 16. As a result, the toner images on the respective photoconductors 11 are sequentially electrostatically attracted to the intermediate transfer belt 15, and the superimposed toner images are formed on the intermediate transfer belt 15.

The secondary transfer unit 20 is configured to include the back surface roll 25 and the secondary transfer roll 22 arranged on the toner image holding surface side of the intermediate transfer belt 15.

In the back surface roll 25, the surface is configured of a tube of the blended rubber of EPDM and NBR rubber in which carbon is dispersed, and the inside is configured of EPDM rubber. Then, the back surface roll is formed to have the surface resistivity of $10^7$Ω/□ or more and $10^{10}$Ω/□ or less, and the hardness is set to, for example, 70° (ASKER C: manufactured by KOBUNSHI KEIKI Co., Ltd., the same applies below). The back surface roll 25 is arranged on the back surface side of the intermediate transfer belt 15 to configure a counter electrode of the secondary transfer roll 22, and a power feeding roll 26 made of metal to which the secondary transfer bias is stably applied is contact-arranged.

On the other hand, the secondary transfer roll 22 is configured of a core body and a sponge layer as an elastic layer fixed around the core body. The core body is a cylindrical rod made of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Moreover, the secondary transfer roll 22 is arranged to be in contact with the back surface roll 25 with the intermediate transfer belt 15 interposed therebetween, and further, the secondary transfer roll 22 is grounded to form a secondary transfer bias with the back surface roll 25. The toner image is secondarily transferred onto the paper K transported to the secondary transfer unit 20.

Further, on the downstream side of the secondary transfer unit 20 of the intermediate transfer belt 15, an intermediate transfer belt cleaner 35 that cleans the surface of the intermediate transfer belt 15 by removing residual toner or paper dust on the intermediate transfer belt 15 after the secondary transfer is provided so as to be detachable from the intermediate transfer belt 15.

The intermediate transfer belt 15, the primary transfer unit 10 (primary transfer roll 16), and the secondary transfer unit 20 (secondary transfer roll 22) correspond to an example of the transfer unit.

On the other hand, on the upstream side of the yellow image forming unit 1Y, a reference sensor (home position sensor) 42 that generates a reference signal as a reference for taking the image forming timing in each of the image forming units 1Y, 1M, 1C, and 1K is provided. The reference sensor 42 recognizes a mark provided on the back side of the intermediate transfer belt 15 and generates a reference signal. According to an instruction from the control unit 40 based on the recognition of the reference signal, each of the image forming units 1Y, 1M, 1C, and 1K is configured to start image formation.

Further, on the downstream side of the black image forming unit 1K, an image density sensor 43 that adjusts an image quality is arranged.

Further, the image forming apparatus according to the present disclosure includes, as a transporting unit that transports the paper K, a paper accommodating unit 50 that accommodates the paper K; a paper feed roll 51 that takes out and transports the paper K accumulated in the paper accommodating unit 50 at a predetermined timing; a transport roll 52 that transports the paper K fed by the paper feed roll 51; a transport guide 53 that feeds the paper K transported by the transport roll 52 to the secondary transfer unit 20; a transport belt 55 that transports the paper K transported after being secondarily transferred by the secondary transfer roll 22, to the fixing device 60; and a fixing inlet guide 56 that guides the paper K to the fixing device 60.

Next, a basic image forming process of the image forming apparatus according to the present disclosure will be described.

In the image forming apparatus according to the present disclosure, image data output from an image reading device (not shown), a personal computer (PC) (not shown), or the like is subjected to image processing by an image processing device (not shown), and then the image forming units 1Y, 1M, 1C, and 1K execute an image forming work.

The image processing device performs image processing such as various image editing such as shading correction, position shift correction, brightness/color space conversion, gamma correction, frame erasing or color editing, and movement editing on the input reflectance data. The image data subjected to the image processing is converted into color material gradation data of four colors of Y, M, C, and K, and is output to the laser exposure machine 13.

In the laser exposure machine 13, for example, the exposure beam Bm emitted from the semiconductor laser is applied to the photoconductors 11 of the image forming units 1Y, 1M, 1C, and 1K according to the input color material gradation data. In each of the photoconductors 11 of the image forming units 1Y, 1M, 1C, and 1K, after the surface is charged by the charger 12, the surface is scanned and exposed by the laser exposure machine 13, and an electrostatic latent image is formed. The formed electrostatic latent image is developed as a toner image of each color of Y, M, C, and K by the each of the image forming units 1Y, 1M, 1C, and 1K.

The toner image formed on the photoconductors 11 of the image forming units 1Y, 1M, 1C, and 1K is transferred onto the intermediate transfer belt 15 in the primary transfer unit 10 in which each photoconductor 11 and the intermediate transfer belt 15 come into contact with each other. More specifically, in the primary transfer unit 10, the primary transfer roll 16 applies a voltage (primary transfer bias) with an opposite polarity to the charging polarity (minus polarity) of the toner to the base material of the intermediate transfer belt 15, and the toner image is sequentially superposed on the surface of the intermediate transfer belt 15 to perform the primary transfer.

After the toner image is sequentially primary transferred to the surface of the intermediate transfer belt 15, the intermediate transfer belt 15 moves and the toner image is transported to the secondary transfer unit 20. In a case where the toner image is transported to the secondary transfer unit 20, in the transporting unit, the paper feed roll 51 rotates in accordance with the timing at which the toner image is transported to the secondary transfer unit 20, and the paper K having a target size is supplied from the paper accommodating unit 50. The paper K supplied by the paper feed roll 51 is transported by the transport roll 52 and reaches the secondary transfer unit 20 via the transport guide 53. Before reaching the secondary transfer unit 20, the paper K is temporarily stopped, and the alignment roll (not shown) rotates according to the movement timing of the intermediate transfer belt 15 on which the toner image is held. Therefore, the position of the paper K and the position of the toner image are aligned.

In the secondary transfer unit 20, the secondary transfer roll 22 is pressed against the back surface roll 25 via the intermediate transfer belt 15. In this case, the paper K transported at the same timing is sandwiched between the intermediate transfer belt 15 and the secondary transfer roll 22. At that time, in a case where a voltage (secondary transfer bias) having the same polarity as the charging polarity (minus polarity) of the toner is applied from the power feeding roll 26, a transfer electric field is formed between the secondary transfer roll 22 and the back surface roll 25. The unfixed toner image held on the intermediate transfer belt 15 is electrostatically transferred onto the paper K collectively in the secondary transfer unit 20 pressed by the secondary transfer roll 22 and the back surface roll 25.

Thereafter, the paper K on which the toner image is electrostatically transferred is transported as-is in a state of being peeled off from the intermediate transfer belt 15 by the secondary transfer roll 22, and is transported to the transport belt 55 provided on the downstream side of the secondary transfer roll 22 in the paper transport direction. The transport belt 55 transports the paper K to the fixing device 60 according to the optimum transport speed in the fixing device 60. The unfixed toner image on the paper K transported to the fixing device 60 is fixed on the paper K by being subjected to a fixing process by heat and pressure by the fixing device 60. The paper K on which the fixed image is formed is transported to an ejected paper accommodating portion (not shown) provided in the ejection unit of the image forming apparatus.

On the other hand, after the transfer to the paper K is completed, the residual toner remaining on the intermediate transfer belt 15 is transported to the cleaning unit as the intermediate transfer belt 15 rotates, and is removed from the intermediate transfer belt 15 by the cleaning back surface roll 34 and the intermediate transfer belt cleaner 35.

Although the present exemplary embodiment has been described above, the present disclosure is not limited to the above exemplary embodiments, and various modifications, changes, and improvements may be made.

EXAMPLES

Hereinafter, the present disclosure will be described in more detail with reference to examples. However, the present disclosure is not limited to the following examples.

Example 1

Formation of Base Material Layer (Endless Belt)

N-Methyl-2-pyrrolidone (NMP) and acicular aluminum nitride single crystal are mixed at a mass ratio of 82:18 to prepare a dispersion liquid. The obtained dispersion liquid is subjected to high-pressure dispersion treatment (condition: 3 times at 200 MPa) with a high-pressure homogenizer (HC3 manufactured by Sanmaru Kikai Kogyo Co., Ltd.).

Subsequently, 1,000 parts by mass of a polyamic acid solution (manufactured by Unitica: TX-HMM (polyimide varnish), solid content concentration: 18% by mass, solvent: NMP) is added to 100 parts by mass of the dispersion liquid after the high-pressure dispersion treatment, and agitated for 60 minutes while vacuuming with a planetary mixer (ACM-5LVT, manufactured by Aikosha Seisakusho Co., Ltd.).

According to the above, a coating liquid containing 10% by mass of the acicular aluminum nitride single crystal in the solid content is obtained.

Next, the obtained coating liquid is applied onto a cylindrical mold by a flow coating method (conditions: rotation speed of the mold is 500 rpm, and moving speed of a discharge portion in a rotation axis direction of the mold is 100 mm/min) to form a coating film, and the coating film is fired at 380° C. to form an endless belt (base material layer) having a film thickness of 80 μm.

Formation of Elastic Layer

Next, a liquid silicone rubber (manufactured by Shin-Etsu Chemical Co., Ltd., X34-1053) is applied to the outer peripheral surface of the obtained base material layer and heated at 110° C. for 15 minutes to obtain an elastic layer having a film thickness of 400 μm.

Formation of Surface Layer

Next, a fluororesin tube having a film thickness of 30 μm containing PFA is formed by injection molding.

The fluororesin tube is put on the elastic layer and heated at 200° C. for 120 minutes to form a surface layer consisting of a fluororesin tube.

Through the above steps, a fixing belt is obtained.

Examples 2 to 16 and Comparative Examples 1 to 9

In the formation of the base material layer of Example 1, an endless belt (base material layer) is formed in the same manner as in Example 1, except that the kind and the amount of the filler added are appropriately changed as shown in Table 1 or 2. Next, an elastic layer and a surface layer are formed on the base material layer in the same manner as in Example 1 to prepare a fixing belt.

In Example 16, an elastic layer is formed in the same manner as in the Example 1 and then a surface layer is formed in the same manner as in Example 1, except that a coating liquid obtained by mixing 85 parts by mass of liquid silicone rubber (manufactured by Shin-Etsu Chemical Co., Ltd., X34-1053) and 15 parts by mass of acicular aluminum nitride single crystal having a thermal conductivity of 270 W/mK and a volume resistivity of $10^{15}$ Ωcm is used.

Measurement of Thermal Conductivity and Volume Resistivity

The thermal conductivity and the volume resistivity of the filler used in each example are measured according to the method described above.

In addition, the thermal conductivity and the volume resistivity of the base material layer obtained in each example are measured according to the method described above. In addition, the results are shown in Tables 1 and 2.

In addition, in the column of "Difficulty in reacting with water" in Tables 1 and 2, among the filler used in each example, the filler having a property of being difficult to react with water is described as A. Since the granular aluminum nitride used in Comparative Examples 1 and 6 has poorer difficulty in reacting with water than the acicular aluminum nitride single crystal, the difficulty of reacting with water thereof is described as "B".

Dimensional Accuracy

The dimensional accuracy of the base material layer obtained in each example is evaluated according to the following method.

That is, the belt circumference length when the produced endless belt (base material layer) is stored in a high humidity environment of 28° C. and 85 RH % for 24 hours is measured, and a dimensional change rate is determined based on the difference in belt circumference length from that before the storage, and evaluated according to the following criteria.

The dimensional change rate [%] is determined from the following equation.

Dimensional change rate[%]=(Belt circumference length after storage−Belt circumference length before storage)/Belt circumference length before storage×100 Criteria A: Dimensional change rate is less than 1%

B: Dimensional change rate is 1% or more and less than 3%

C: Dimensional change rate is 3% or more

Evaluation of Bending Durability

The base material layer obtained in each example is attached to a fixing device of an image forming apparatus (manufactured by FUJIFILM Business Innovation, Versant 3100 Press).

Using the image forming apparatus, a 10% halftone image is continuously output on A4 paper up to 1,000,000 sheets. The fixing belt is removed every 100,000 output sheets, and the presence or absence of cracks or breaks in the taken-out fixing belt is visually confirmed.

The bending durability is evaluated according to the following criteria.

—Criteria—

A: Up to 1,000,000 sheets, no cracks or breaks are found in the base material layer.

B: In 700,000 or more sheets and less than 1,000,000 sheets, a crack or a break in the base material layer is observed.

C: In less than 700,000 sheets, a crack or a break in the base material layer is observed.

Fixing Stability

The fixing belt obtained in each example is attached to a fixing device of an image forming apparatus (manufactured by FUJIFILM Business Innovation, Versant 3100 Press).

Using the image forming apparatus, 30 sheets of a 10% halftone image are continuously output on A3 paper. With respect to the output 30 sheets, the presence or absence of an image distortion due to the toner scattering in front of the fixing nip portion is visually confirmed. It is considered that the image distortion caused by the scattering of the toner generated here affects charging characteristics of the toner on the paper in a case where the insulation between the fixing belt and the heating pressing roll is not ensured.

The fixing stability is evaluated according to the following criteria.

—Criteria—

A: No image distortion is observed due to toner scattering on all 30 sheets.

B: Image distortion due to toner scattering is observed on 1 or more and less than 10 sheets.

C: Image distortion is observed due to toner scattering on 10 or more sheets.

Evaluation of FPOT

The fixing belt obtained in each example is attached to the fixing device of the above-mentioned image forming apparatus, and the FPOT is measured when the fixing device performs a heating operation by providing 1,200 W from a room temperature state.

The FPOT is evaluated according to the following criteria.

—Criteria—

A: FPOT is shorter than 30 seconds.

B: FPOT is 30 seconds or longer and shorter than 1 minute.

C: FPOT is 1 minute or longer.

Evaluation of Image Defect

The fixing belt obtained in each example is attached to the fixing device of the above image forming apparatus, and the image forming apparatus is stored in a high humidity environment of 28° C. and 85 RH % for 24 hours, and then 30 sheets of 10% halftone images are continuously printed on A3 paper. The presence or absence of image defects is visually confirmed for the 30 output images. It is considered that the image defect generated here is generated in a case where the filler in the base material layer of the fixing belt absorbs moisture and expands, and the peripheral length of the fixing belt exceeds the allowable range.

The Image defect is evaluated according to the following criteria.

—Criteria—

A: No image defects are seen on all 30 images.

B: An image defect is seen in 1 or more and less than 10 images.

C: An image defect is seen on 10 or more images.

Evaluation of Service Life

The fixing belt obtained in each example is attached to the fixing device of the above-mentioned image forming apparatus, and 10% halftone images are continuously output on A4 paper up to 1,000,000 sheets. The presence or absence of a fixing failure and uneven gloss on the output image is confirmed every 100,000 output sheets. The fixing failure and the uneven gloss described here occur when cracks or breaks occur in the base material layer of the fixing belt.

The service life is evaluated according to the following criteria.

—Criteria—

A: Up to 100,000 sheets, the fixing failure and the uneven gloss are found in the fixing belt.

B: At least one of the fixing failure or the uneven gloss is observed in 700,000 or more and less than 1,000,000.

C: With less than 700,000 sheets, at least one of the fixing failure or the uneven gloss is observed.

TABLE 1

| | Filler | | | | | | | | | Endless |
|---|---|---|---|---|---|---|---|---|---|---|
| | Kind | Shape | Thermal conductivity [W/mK] | Volume resistivity [Ωcm] | Length [μm] | Diameter [μm] | Aspect ratio | Difficulty in reacting with water | Content [% by mass] | belt Volume resistivity [Ωcm] |
| Example 1 | Aluminum nitride single crystal | Acicular | 270 | $10^{15}$ | 2000 | 2 | 1000 | A | 10 | $10^{15}$ |
| Example 2 | Aluminum nitride single crystal | Acicular | 270 | $10^{15}$ | 2000 | 2 | 1000 | A | 25 | $10^{15}$ |
| Example 3 | Aluminum nitride single crystal | Acicular | 270 | $10^{15}$ | 2000 | 2 | 1000 | A | 5 | $10^{15}$ |
| Example 4 | Aluminum nitride single crystal | Acicular | 270 | $10^{15}$ | 2000 | 2 | 1000 | A | 1 | $10^{15}$ |
| Example 5 | Aluminum nitride single crystal | Acicular | 270 | $10^{15}$ | 2000 | 2 | 1000 | A | 30 | $10^{15}$ |
| Example 6 | Aluminum nitride single crystal | Acicular | 270 | $10^{15}$ | 50 | 2 | 25 | A | 10 | $10^{15}$ |
| Example 7 | Aluminum nitride single crystal | Acicular | 270 | $10^{15}$ | 110 | 2 | 55 | A | 10 | $10^{15}$ |
| Example 8 | Aluminum nitride single crystal | Acicular | 270 | $10^{15}$ | 5800 | 3 | 1930 | A | 10 | $10^{15}$ |
| Example 9 | Aluminum nitride single crystal | Acicular | 270 | $10^{15}$ | 6510 | 3 | 2170 | A | 10 | $10^{15}$ |
| Example 10 | Aluminum nitride single crystal | Acicular | 270 | $10^{15}$ | 2000 | 0.8 | 2500 | A | 10 | $10^{15}$ |
| Example 11 | Aluminum nitride single crystal | Acicular | 270 | $10^{15}$ | 2000 | 1.2 | 1666 | A | 10 | $10^{15}$ |
| Example 12 | Aluminum nitride single crystal | Acicular | 270 | $10^{15}$ | 2000 | 3.8 | 526 | A | 10 | $10^{15}$ |
| Example 13 | Aluminum nitride single crystal | Acicular | 270 | $10^{15}$ | 2000 | 4.5 | 444 | A | 10 | $10^{15}$ |

TABLE 1-continued

| | | | | | | | | | | |
|---|---|---|---|---|---|---|---|---|---|---|
| Example 14 | Aluminum nitride single crystal | Acicular | 270 | $10^{15}$ | 2000 | 2 | 1000 | A | 10 | $10^{15}$ |
| Example 15 | Aluminum nitride single crystal | Acicular | 270 | $10^{15}$ | 2000 | 2 | 1000 | A | 10 | $10^{15}$ |
| Example 16 | Aluminum nitride single crystal | Acicular | 270 | $10^{15}$ | 2000 | 2 | 1000 | A | 10 | $10^{15}$ |

| | Endless belt | | | | | | Fixing system | | | |
|---|---|---|---|---|---|---|---|---|---|---|
| | Thermal conductivity [W/mK] | | | Filler | | | | | | |
| | Thickness direction | Axis direction | Circumferential direction | orientation ratio | Dimensional accuracy | Bending durability | Fixing stability | FPOT | Image defect | Service life |
| Example 1 | 0.7 | 0.7 | 1.5 | 90 | A | A | A | A | A | A |
| Example 2 | 1 | 1 | 2 | 90 | A | A | A | A | A | A |
| Example 3 | 0.5 | 0.5 | 1 | 90 | A | A | A | A | A | A |
| Example 4 | 0.3 | 0.3 | 0.6 | 90 | A | A | A | B | A | A |
| Example 5 | 1.1 | 1.1 | 2.2 | 90 | B | B | A | A | B | B |
| Example 6 | 0.4 | 0.4 | 0.8 | 90 | A | A | A | B | A | A |
| Example 7 | 0.5 | 0.5 | 1 | 90 | A | A | A | A | A | A |
| Example 8 | 0.7 | 0.7 | 2 | 90 | A | A | A | A | A | A |
| Example 9 | 0.7 | 0.7 | 2.2 | 90 | A | B | A | A | A | B |
| Example 10 | 0.4 | 0.4 | 0.8 | 90 | A | A | A | B | A | A |
| Example 11 | 0.5 | 0.5 | 1 | 90 | A | A | A | A | A | A |
| Example 12 | 0.6 | 0.6 | 1.8 | 90 | A | A | A | A | A | A |
| Example 13 | 0.7 | 0.7 | 1.9 | 90 | A | B | A | A | A | B |
| Example 14 | 0.7 | 0.7 | 0.8 | 65 | A | A | A | B | A | A |
| Example 15 | 0.7 | 0.7 | 1 | 72 | A | A | A | A | A | A |
| Example 16 | 0.7 | 0.7 | 1.5 | 90 | A | A | A | A | A | A |

TABLE 2

| | Filler | | | | | | | | | Endless |
|---|---|---|---|---|---|---|---|---|---|---|
| | Kind | Shape | Thermal conductivity [W/mK] | Volume resistivity [Ωcm] | Length [μm] | Diameter [μm] | Aspect ratio | Difficulty in reacting with water | Content [% by mass] | belt Content [% by mass] |
| Comparative Example 1 | Aluminum nitride | Granular | 200 | $10^{15}$ | 6 | 3 | 2 | B | 10 | $10^{15}$ |
| Comparative Example 2 | Alumina | Granular | 25 | $10^{15}$ | 200 | 100 | 2 | A | 10 | $10^{15}$ |
| Comparative Example 3 | Alumina | Granular | 25 | $10^{15}$ | 200 | 100 | 2 | A | 80 | $10^{15}$ |
| Comparative Example 4 | Boron nitride | Scalelike | 80 | $10^{15}$ | — | — | — | A | 10 | $10^{15}$ |
| Comparative Example 5 | Boron nitride | Scalelike | 80 | $10^{15}$ | — | — | — | A | 50 | $10^{15}$ |
| Comparative Example 6 | Aluminum nitride | Granular | 200 | $10^{15}$ | 6 | 3 | 2 | B | 30 | $10^{15}$ |
| Comparative Example 7 | Glass | Fibrous | 1 | $10^{15}$ | 300 | 10 | 30 | A | 60 | $10^{15}$ |

TABLE 2-continued

| | | | | | | | | | | |
|---|---|---|---|---|---|---|---|---|---|---|
| Comparative Example 8 | Potassium titanate | Acicular | 1.7 | $10^{15}$ | 15 | 0.5 | 30 | A | 60 | $10^{15}$ |
| Comparative Example 9 | Carbon nanotube | Fibrous | 6000 | $10^{-4}$ | 15 | 0.03 | 500 | A | 10 | $10^{-1}$ |

| | Endless belt | | | | | | Fixing system | | | |
|---|---|---|---|---|---|---|---|---|---|---|
| | Thermal conductivity [W/mK] | | | Filler | | | | | | |
| | Thickness direction | Axis direction | Circumferential direction | orientation ratio | Dimensional accuracy | Bending durability | Fixing stability | FPOT | Image defect | Service life |
| Comparative Example 1 | 0.45 | 0.45 | 0.45 | — | B | A | A | C | B | A |
| Comparative Example 2 | 0.35 | 0.35 | 0.35 | — | A | A | A | C | B | A |
| Comparative Example 3 | 0.45 | 0.45 | 0.45 | — | C | C | A | B | C | C |
| Comparative Example 4 | 0.37 | 0.37 | 0.37 | — | A | A | A | C | A | A |
| Comparative Example 5 | 0.45 | 0.45 | 0.45 | — | A | C | A | B | A | C |
| Comparative Example 6 | 0.47 | 0.47 | 0.47 | — | C | B | A | B | C | B |
| Comparative Example 7 | 0.3 | 0.3 | 0.3 | 90 | A | C | A | C | A | C |
| Comparative Example 8 | 0.3 | 0.3 | 0.3 | 90 | A | C | A | C | A | C |
| Comparative Example 9 | 1.2 | 1.2 | 2.4 | 90 | A | A | C | A | A | A |

From the above results, it can be seen that the base material layer (endless belt) of the present example has higher insulation and thermal conductivity (specifically, thermal conductivity in the circumferential direction is 0.5 W/mK or more) and excellent bending durability, than the base material layer (endless belt) of the comparative examples. It can be seen that the fixing belt of present example is more excellent in all of fixing stability, shortening of FPOT, the image defect, and the service life, comparing to the fixing belt of the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt comprising:

a resin; and an acicular filler of which a thermal conductivity is 220 W/mK or more and 320 W/mK or less, a volume resistivity is $10^{11}$ Ωcm or more and $10^{16}$ Ωcm or less, and a content with respect to the endless belt is 1% by mass or more and 30% by mass or less.

2. The endless belt according to claim 1, wherein the endless belt has a thermal conductivity in a circumferential direction of 0.5 W/mK or more and 3.0 W/mK or less and a volume resistivity of $10^{13}$ Ωcm or more and $10^{16}$ Ωcm or less.

3. The endless belt according to claim 1, wherein the acicular filler is an aluminum nitride single crystal.

4. The endless belt according to claim 2, wherein the acicular filler is an aluminum nitride single crystal.

5. The endless belt according to claim 1, wherein the acicular filler has a length of 100 μm or more and 6,000 μm or less.

6. The endless belt according to claim 2, wherein the acicular filler has a length of 100 μm or more and 6,000 μm or less.

7. The endless belt according to claim 5, wherein the acicular filler has a diameter of 1 μm or more and 4 μm or less.

8. The endless belt according to claim 1, wherein the acicular filler has an aspect ratio of 100 or more and 2,000 or less.

9. The endless belt according to claim 1, wherein the acicular filler is oriented in a circumferential direction of the endless belt.

10. The endless belt according to claim 9, wherein an orientation ratio of the acicular filler with respect to the circumferential direction of the endless belt is 70% or more.

11. A fixing belt comprising:

the endless belt according to claim 1; and a surface layer provided on an outer peripheral surface of the endless belt.

12. The fixing belt according to claim 11, further comprising:

an elastic layer provided between the endless belt and the surface layer.

13. The fixing belt according to claim 12, wherein the elastic layer contains an acicular filler having a thermal conductivity of 220 W/mK or more and 320 W/mK or less, and a volume resistivity of $10^{11}$ Ωcm or more and $10^{16}$ Ωcm or less.

14. The fixing belt according to claim 13, wherein the acicular filler contained in the elastic layer is an aluminum nitride single crystal.

15. A fixing device comprising:

a first rotating body consisting of the endless belt according to claim 11;

a second rotating body arranged in contact with an outer peripheral surface of the first rotating body; and a pressing member that is arranged inside the first rotating body and presses the first rotating body against the second rotating body from an inner peripheral surface of the first rotating body.

16. An image forming apparatus comprising:

an image holder;

a charging device that charges a surface of the image holder;

a latent image forming device that forms a latent image on the charged surface of the image holder;

a developing device that develops the latent image by a toner to form a toner image;

a transfer device that transfers the toner image to a recording medium; and the fixing device according to claim 15 that fixes the toner image to the recording medium.

* * * * *